United States Patent [19]

Kuehl et al.

[11] 4,170,295

[45] Oct. 9, 1979

[54] MULTI-PRODUCT CARTON WITH PRODUCT RETAINING FEATURES

[75] Inventors: Donald R. Kuehl, Menasha; David C. Mueller, Neenah; George L. Meyers, Menasha, all of Wis.

[73] Assignee: American Can Company, Greenwich, Conn.

[21] Appl. No.: 820,355

[22] Filed: Jul. 29, 1977

[51] Int. Cl.[2] ..... B65D 65/24

[52] U.S. Cl. ..... 206/45.34; 206/429; 229/27; 229/87 F

[58] Field of Search ..... 206/45.25, 45.34, 149, 206/216, 526, 429, 45.14, 45.19, 157; 229/87 F, 87 B, 40, 27

[56] References Cited

U.S. PATENT DOCUMENTS

| | | | |
|---|---|---|---|
| 2,738,055 | 3/1956 | Shanahan | 206/45.34 X |
| 2,853,183 | 9/1958 | Guyer | 206/216 |
| 3,080,966 | 3/1963 | Kuchenbecker | 206/429 |
| 3,343,665 | 9/1967 | Marino | 229/27 |
| 3,638,787 | 2/1972 | Phillips, Jr. | 229/27 X |
| 3,713,530 | 1/1973 | Hanko | 206/45.14 |
| 3,724,650 | 4/1973 | Forbes, Jr. | 206/45.19 |
| 3,901,386 | 8/1975 | Hennessey | 206/429 X |
| 3,913,739 | 10/1975 | Hennessey | 206/429 X |

FOREIGN PATENT DOCUMENTS

| | | | |
|---|---|---|---|
| 1067305 | 6/1954 | France | 206/277 |
| 1130193 | 10/1968 | United Kingdom | 229/23 AB |

*Primary Examiner*—Joseph Man-Fu Moy
*Attorney, Agent, or Firm*—Robert P. Auber; George P. Ziehmer; Ira S. Dorman

[57] ABSTRACT

Cartons, folded from blanks and multi-component products, for example, a rigid container and a flexible pouch, are formed into a package wherein the container is separated from the pouch, without the use of partitions or compartments and wherein the container is positively secured against movement into or out of the carton. In one embodiment, the carton comprises an enclosing band which provides a particularly attractive surface for graphics and conveys a tamperproof feature to the package.

2 Claims, 27 Drawing Figures

FIG. 6
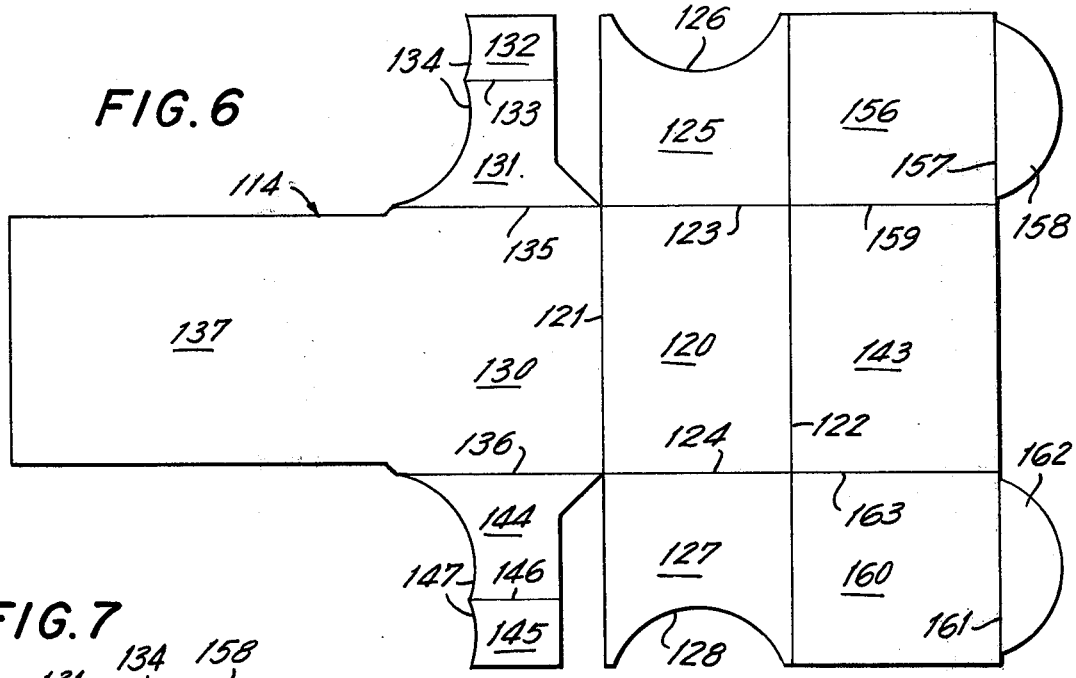
FIG. 7
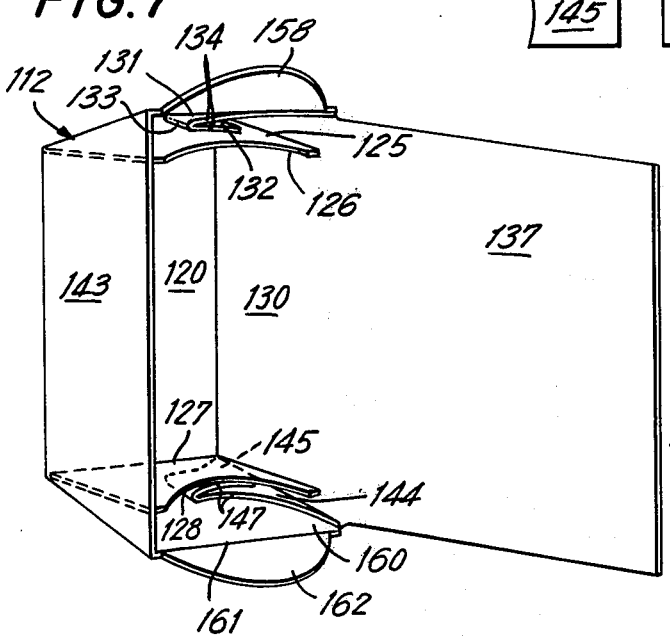
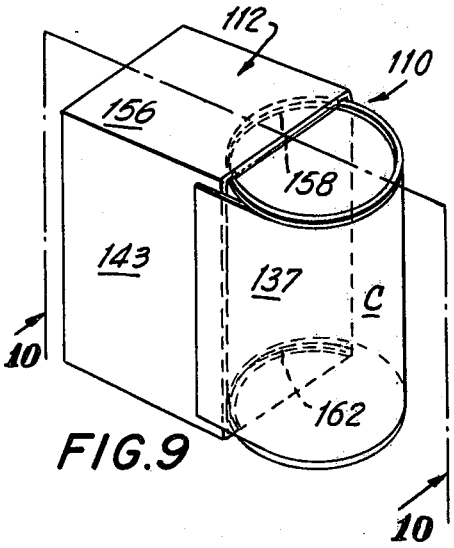
FIG. 9
FIG. 8
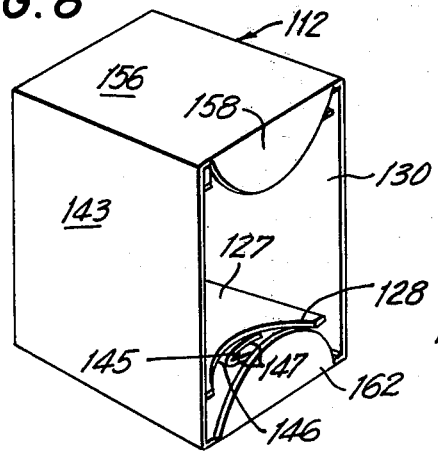
FIG. 10
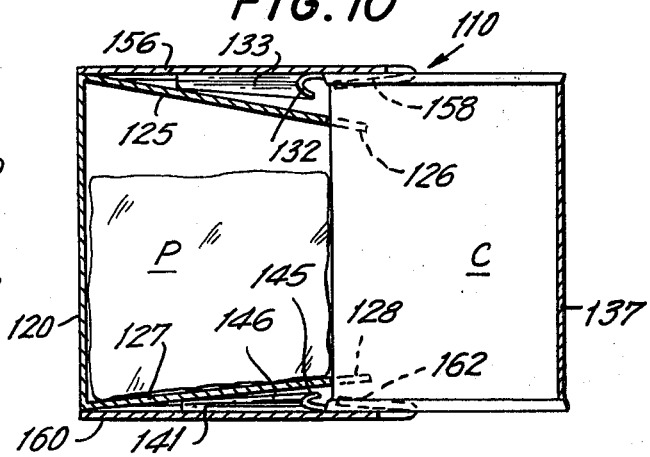

FIG. 17
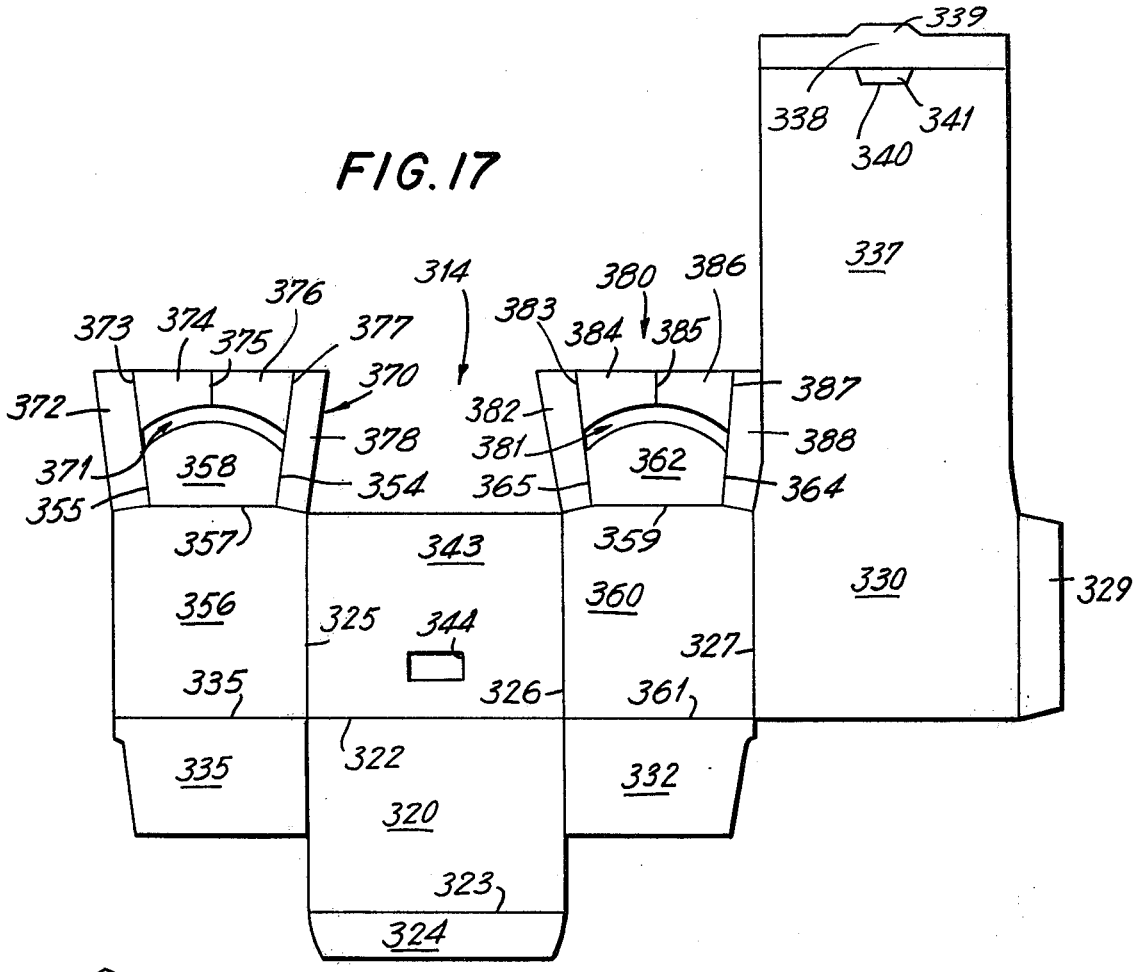
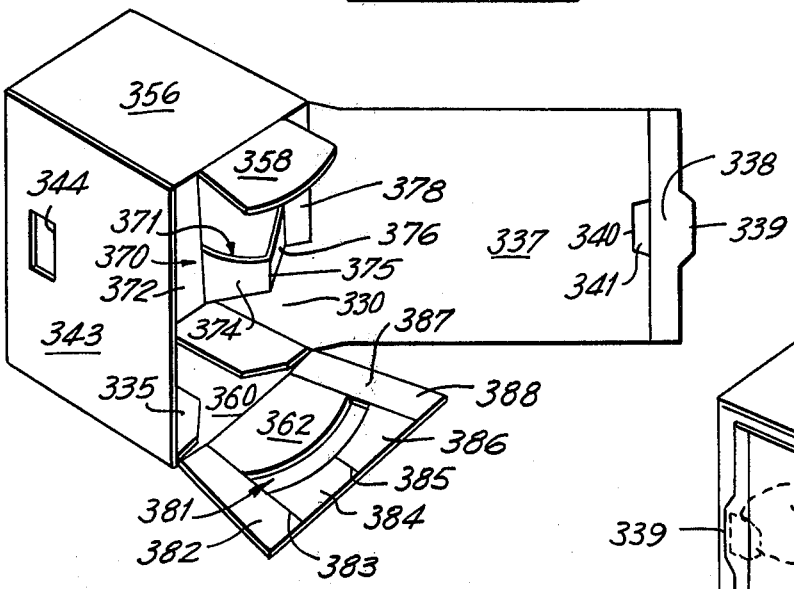
FIG. 18
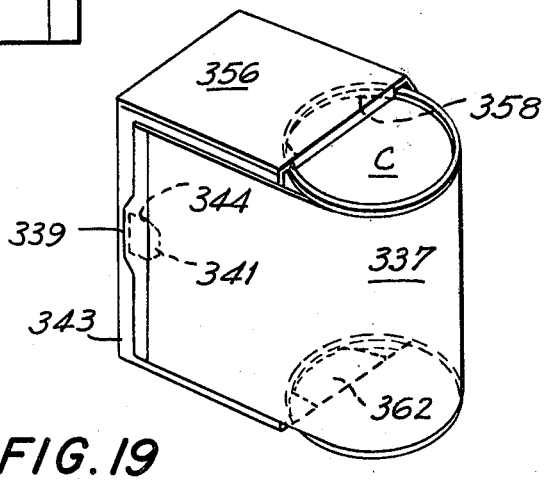
FIG. 19

MULTI-PRODUCT CARTON WITH PRODUCT RETAINING FEATURES

BACKGROUND OF THE INVENTION

It is known to produce a package for containing both a physically strong container such as a metal can and a relatively weak or smaller container such as a flexible pouch or even containers of different size. The major problem in the design and construction of such packages is in the provision of means whereby the heavier container does not move in the package to crush or otherwise damage the lighter article, particularly where such article is a flexible pouch. Among the packaging devices that have been proposed for such multi-component packages are cartons partitioned or compartmentalized with separating panels, banding devices which simply band the products together, holders which comprise sleeves into which the cans are inserted or with which the cans are wrapped or cartons in which the components are arranged side-by-side. Neither holders nor bands provide suitable areas for proper advertising; provision of separating panels is wasteful and adds to the cost of the package, and side by side arrangements result in larger packages which necessitate wasteful storage and shelf space. it is therefore highly desirable and advantageous to produce a multi-component package which eliminates the aforementioned difficulties.

It is an object of the present invention to provide multi-component packages comprising a carton, a rigid container of product and a flexible article of product. The invention has as its particular objects the provision of a package in which the container is confined in a predetermined area and is positively secured against movement in the package; in which damage to the flexible article by movement of this container is substantially minimized; in which the amount of storage and the shelf-space the package requires is minimized and in which the area for graphics and or advertising or decoration on the package is maximized.

SUMMARY OF THE INVENTION

These and other objects are realized in the multi-component package of this invention composed of a carton folded from a blank, a flexible article and a rigid container constructed so that the container is positively secured and held off the bottom or back end of the carton to provide a hollow area for containing the flexible article. Broadly, the package comprises means for defining an area inside the carton in which the rigid container is confined and beyond which it cannot extend thus providing a hollow area adapted to receive and confine the flexible article in combination with means for engaging the chimes of the container to secure it within said confined area.

The confining and securing means may be in the form of several embodiments, each of which will positively secure and confine the container insuring against movement thereof in the package. Such combination confining and securing means comprise at least two of the following features wherein any one or more of the confining means (A) crossed minor flaps or (B) arcuate cut-out flaps elevated off the top and bottom ends by in-folded cut-out side tabs or (C) tapered three-creased flaps or (D) tapered side and end walls with either arcuate and preferably semi-circular cut-lines or tapered side score lines, is utilized in combination with positive securing means comprising (E) arcuate and preferably semi-circular chime engaging tabs or, if desired, (F) such tabs in combination with an enclosing band which encircles that portion of the container projecting from the carton.

Optionally, the carton embodying at least one of said confining means in combination with said securing means may also include an automatic preglued bottom whereby the carton may be shipped in a collapsed condition and, upon erection of the carton, the bottom members are automatically moved to their bottom forming positions.

From the description that follows, it will be apparent that the confining means may be carried by one or both of the sidewalls, the back end wall, or the top and bottom end wall and combinations thereof. In general, at least two of the wall-defining panels in the carton blank will carry means for defining an area in which the rigid product container is to be confined while the top and bottom end wall-defining panels will carry the securing means.

BRIEF DESCRIPTION OF THE DRAWINGS

Further details of the invention will be apparent in the description of the drawings wherein:

FIG. 6 is a plan view of a paperboard carton comprising another preferred embodiment of the invention, FIG. 7 is a perspective view of the empty carton constructed from the blank of FIG. 6, FIG. 8 is a perspective view of a modification of the carton of FIG. 7, FIG. 9 is a perspective view of the package constructed from the carton of FIG. 7, FIG. 10 is a cross-section of the package of FIG. 9 taken along the line 10—10, FIG. 17 is a plan view of a blank which adapts the holding features of the blank of FIG. 11, FIG. 18 is a perspective view of the constructed carton, FIG. 19 is a perspective view of the package constructed from the blank of FIG. 17.

DETAILED DESCRIPTION OF THE PREFERRED EMBODIMENTS

Figure 4:
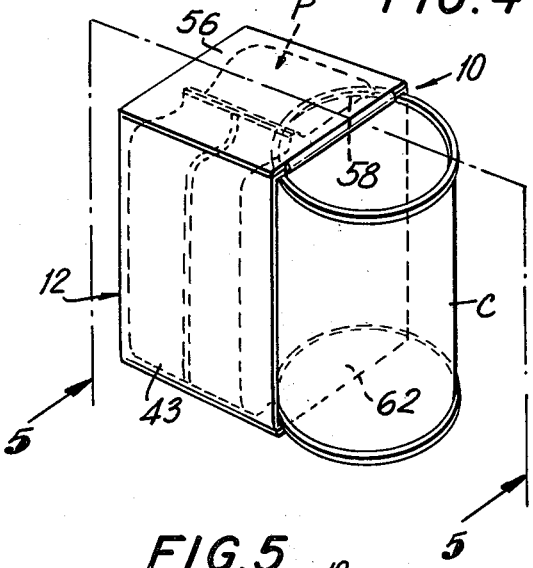
FIG. 4 is a perspective view of a package of the invention containing the multi-components.

A package of the invention 10 is shown assembled in FIG. 4. A rigid container, for example a metal can C of product and a soft flexible article, for example a pouch P (shown in phantom) are packed in top to bottom, back to front relationship within an erected carton 12. Can C is confined in a predetermined area at the front of the carton and is positively secured therein, without adhesives by means of at least two confining and securing features of this invention to prevent shifting motion or other movement within the carton that would cause damage to the flexible pouch P or to the contents thereof, such as noodles, spaghetti, etc.

Figure 1:
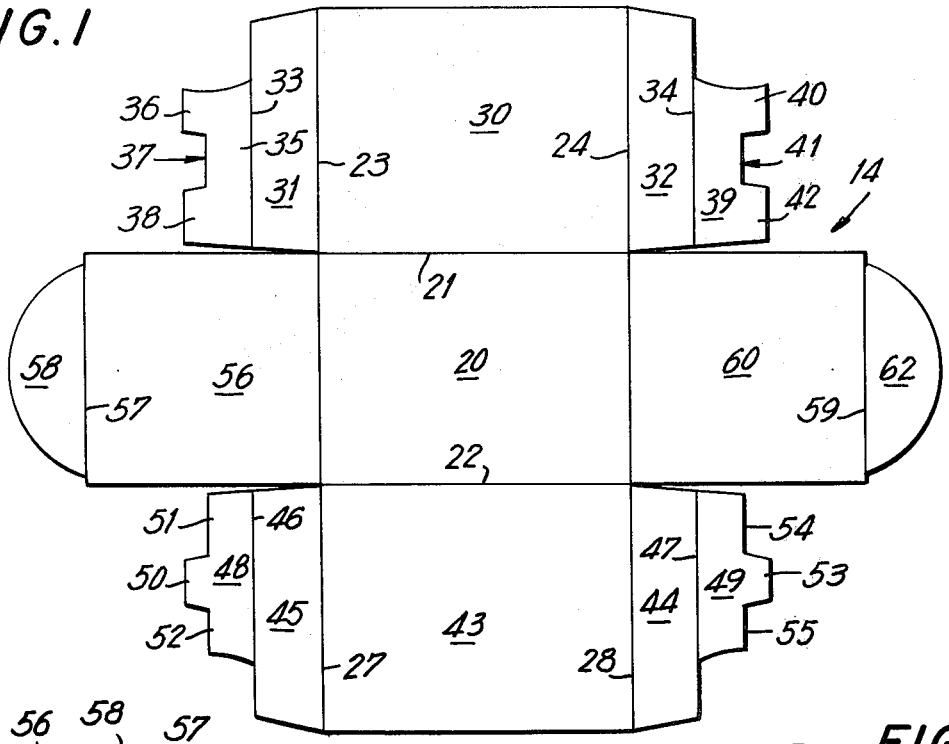
FIG. 1 is a plan view of a paperboard carton blank comprising a preferred embodiment of the invention.
Figure 2:
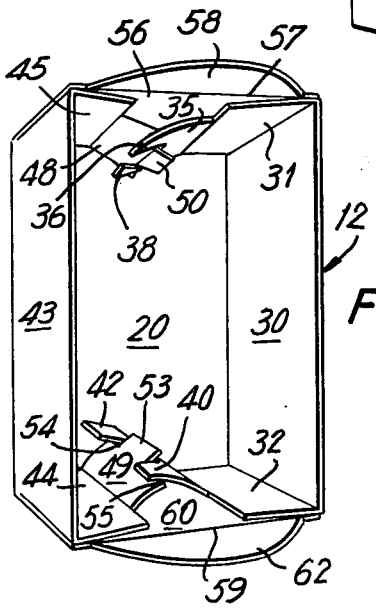
FIG. 2 is a perspective view of the empty carton constructed from the blank of FIG. 1.
Figure 3:
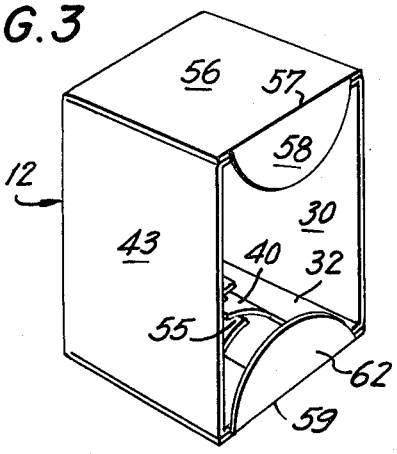
FIG. 3 is a perspective view of the carton of FIG. 2 ready for loading.

The carton 12 of this invention is formed from a flat blank 14 as seen in FIG. 1, the erected empty carton eing shown in FIGS. 2 and 3. The carton blank includes an end wall 20, a side wall 30 and a side wall 43, which walls are foldably connected along parallel fold lines 21 and 22. Sidewalls 30 and 43 are hingedly connected to glue flaps 31, 32, 44, and 45 through fold lines 23, 24, 27 and 28. Glue flaps 31, 32, 45 and 44 are in turn hingedly connected through fold lines 33, 34, 46 and 47 to minor flaps 35, 39, 48 and 49, respectively. Minor flaps 35 and 39 carry at their ends slots 37 and 41, respectively, and flanking lock tabs 36, 38 and 40 and 42. On the opposite sidewall, minor flaps 48 and 49 carry at their ends lock tabs 50 and 53 which are flanked by slots 51, 52 and 54 and 55. The glue flaps and minor flaps are designed to serve a specific function in defining a predetermined area in which the rigid container will be confined as discussed hereinbelow. Hingedly connected to end wall 20 through fold lines 25 and 26 are top and bottom panels 56 and 60 respectively, which form the top and bottom ends of the carton. Hingedly connected to said top and bottom end panels through fold lines 57 and 59 are semi-circular chime engaging tabs 58 and 62.

CROSS-MINOR FLAPS

Figure 5:
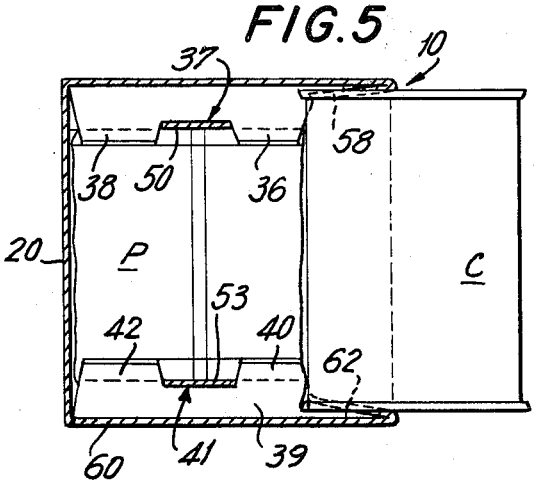
FIG. 5 is a cross-section of the package of FIG. 4 taken along the line 5—5.

This feature is best seen in FIGS. 1 to 5. The carton is erected by folding glue flaps 31, 32, 44 and 45 about their respective fold lines and likewise folding the side walls 30 and 43. Lock tabs 36 and 38 are inserted into slots 52 and 51 while lock tab 50 enters slot 37. The minor flaps 35 and 48 and their respective tabs and slots become crossed and locked as best seen in FIG. 2. Glue is affixed to the outer surface of glue tabs 31 and 45 after which the side edges of the top end panel 56 are aligned to overlie the fold lines 23 and 27 of the sidewall 30. The distance between the fold lines 23 and 27 is slightly greater than the width of the top end wall 30. Therefore to effect an alignment of the fold lines with the edges of the top wall panel, it is necessary to push in or squeeze the respective side walls. Such squeezing action causes the crossed minor flaps and their component tabs 36, 38 and 50 to project downwardly from the top end into the carton and they are fixed in this position when the glue tabs are adhesively secured to the top end. The sequence is repeated in assembling the bottom wall panel 60 over the glue flaps 32 and 44 resulting in crossing of the minor flaps 39 and 49, locking of the corresponding lock tabs 40 and 42 in the slots 55 and 54 and lock tab 53 into the slot 41. Glueing of the aligned bottom wall edges and glue flaps causes the crossed minor flaps to project upwardly from the bottom end into the carton. As best seen in FIG. 5, the projecting flap portions 36 at the top and 40 at the bottom define an area beyond which the rigid container or can C cannot extend into the carton.

SEMI-CIRCULAR CHIME ENGAGING TABS

As described above, the top and bottom end panels 56 and 60 have arcuate tabs 58 and 62, respectively, foldably connected thereto by fold lines 57 and 59. The tabs are foldable 180 degrees inwardly into the carton to engage the chimes of the can enclosed in the carton and to further secure the can adjacent the open front of the carton. Chime engaging tabs are per se known in the art. However, when used in combination with one or another of the confining features described herein, the tabs depending from the top and bottom end panels serve to provide an appreciably more secure package. As best seen in FIG. 2, in the initial assembly of the carton, the tabs extend outwardly from the top and bottom ends. Before loading or after loading the flexible article only, the tabs are folded downwardly from the top and upwardly from the bottom. Preferably, in all of the embodiments hereindescribed, the arcuate tabs are so configured that, when folded into the empty carton, the center of the free arcuate edge will substantially abut the edge of the means defining the confining area. Upon loading the rigid container, as the can is pushed into the carton, the tabs are forced inwardly substantially 180 degrees. When the can is beyond these tabs and is stopped by the projecting crossed minor flaps, the tabs in a tendency to return to a more normal plane will drop (or rise at the bottom) to engage the chimes of the container rim. Such engagement exerts a wedging action between the tabs and the can which functions to prevent movement of the can either into or out of the carton.

ARCUATE CUT-OUT FLAPS AND IN-FOLDED CUT-OUT SIDE TABS

In a modification of the means for defining the area in which the rigid container is confined in the container, the crossed minor flaps just described may be substituted by elevated cutout flaps as best seen in FIGS. 6 to 10. In this embodiment, the confining feature is the cut-out flaps 125 and 127 and their relationship with the infolded cut-out side tabs 131 and 144. The blank 114 is illustrated in FIG. 6. It will be seen that end wall 120 has cut-out flaps 125 and 127 hingedly connected at either end by fold lines 123 and 124. The cut-out flaps have arcuate edges 126 and 128 defined by arcuate cut-out portions that are complementary in shape to the arcuate chime grabbers 158 and 162. Glue flaps 131 and 144, which are hingedly connected to sidewall 130 through fold lines 135 and 136, respectively, additionally comprise foldable tabs 132 and 145 hingedly connected thereto by fold lines 133 and 146, respectively.

The glue flaps 131 and 144 also have arcuate cut-out portions 134 and 147 which are complementary in shape to the arcuate edges 126 and 128 of the end wall cut-out flaps 125 and 127. The carton is assembled by first folding down end wall cut-out flaps 125 and 127 along fold lines 123 and 124. Sidewalls 130 and 143 are next folded in about fold lines 121 and 122. The glue flaps 131 and 144 are folded about their respective fold lines 135 and 136 to overlap cut-out flap 125 at the top end to lie under cut-out flap 127 at the bottom end. The tabs 132 and 145 of the cut-out glue flaps 131 and 144 are folded inwardly along hinge lines 133 and 146 respectively so that the inward fold lies under the respective cut-out glue flaps 131 and 144. As a result, infolded tab 132 also overlies cut-out flap 125 at the top end while infolded tab 145 lies under cut-out flap 127 at the bottom end. To complete the assembly, top end panel 156 is folded about fold line 159 and is glued to the top of the cut-out glue flap 131. Infolded cut-out tab 132 is not glued but is left free to act as a lever on the top of the cut-out flap 125, as best seen in FIGS. 7 and 10. The sequence is repeated at the bottom end wherein bottom end wall 160 is folded about fold line 163 and is glued to the cut-out glue flap 144 leaving the infolded cut-out tab 145 to act as a lever on the bottom of cut-out flap 127. The carton is ready for loading of the pouch at this point after which the chime engaging tabs 158 and 162 are folded inwardly about fold lines 157 and 161 and the container is inserted in the carton. As best seen in FIG. 10 in phantom lines, the cut-out flaps 125 and 127 are held off the bottom and top ends by the infolded cut-out tabs 132 and 145. The arcuate ends 126 and 128 of the cut-out flaps and the complementary arcuate edges 134 and 147 of the cut-out glue flaps define an area beyond which the rigid container cannot be pushed into the carton and actually function to hold the container off the hollow area which holds the pouch. At the same time, the infolded cut-out tabs tend to force the chime-engaging tabs to stand up and insure the closest contact between these tabs and the chimes of the container.

It will be seen from FIG. 7 that the illustrated embodiments may contain an optional enclosing band 137 which is formed integrally with sidewall 130. After loading of the container, the band is wrapped around that portion of the container projecting from the carton and is glued to sidewall 143. Use of this band in the package of the invention conveys several advantages. It provides a tamperproof feature since the package cannot be opened unless the band is unglued or otherwise visibly mutilated. Additionally, it further insures against movement of the rigid container out of the carton. It also provides a particularly suitable area for decoration or advertising making it possible to employ unlabeled containers, if desired.

TAPERED THREE-CREASED FLAPS

Figure 11:
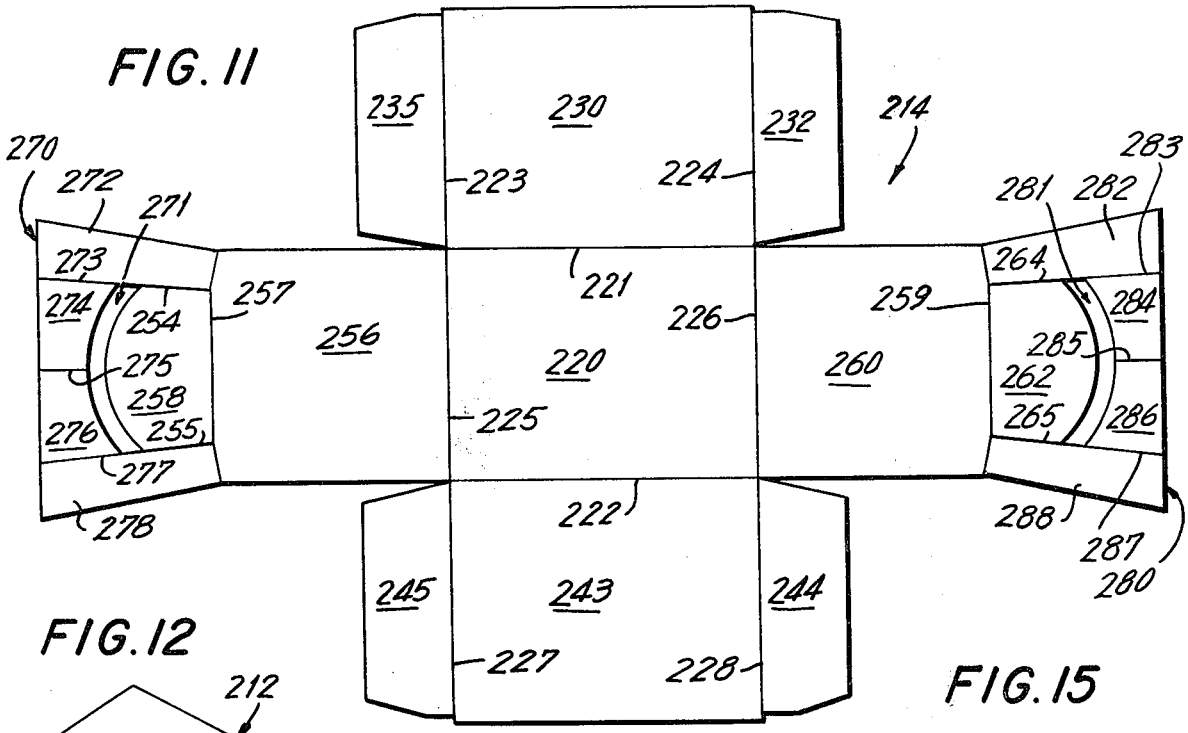
FIG. 11 is a plan view of a carton blank comprising another preferred embodiment of the invention.
Figure 12:
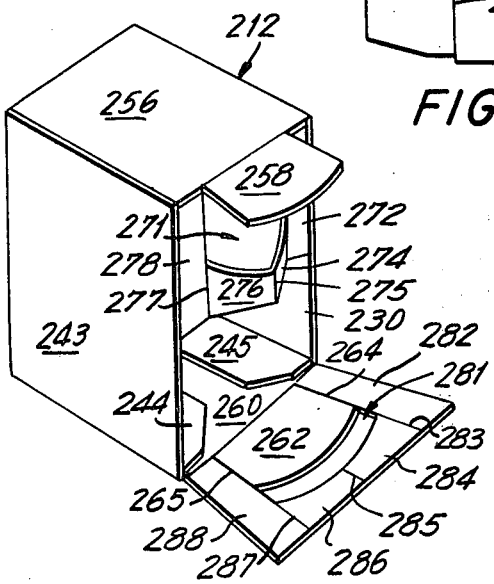
FIG. 12 is a perspective view of the constructed carton partially ready for loading.
Figure 13:
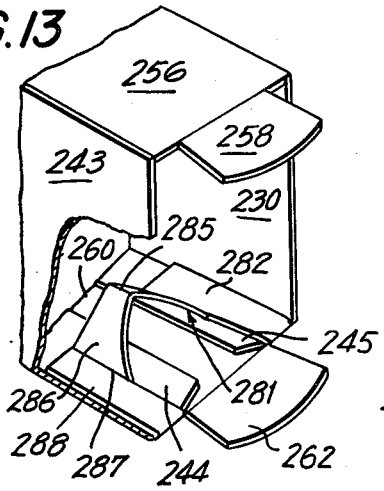
FIG. 13 is a perspective view of the carton of FIG. 12 partially prepared for loading with parts broken away.
Figure 15:
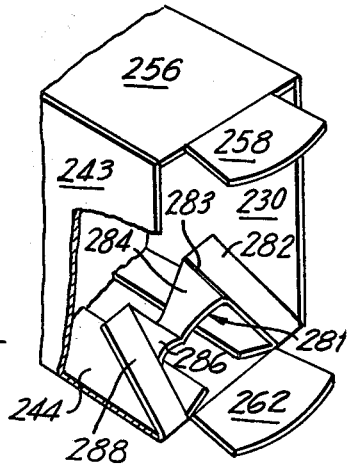
FIG. 15 is a perspective view of the carton of FIG. 12 prepared for loading by a modification of FIG. 13.

The confining means may alternatively be in the form of tapered three-creased flaps as illustrated in FIGS. 11 to 16. With reference to the blank 214 illustrated in FIG. 11, end walls 220, 256 and 260 and sidewalls 230 and 243 are folded as previously described along their respective fold lines 221 to 228, 257 and 259. Glue flaps 232, 235, 244 and 245 are folded inwardly and are adhesively attached to top end wall panel 256 and bottom end wall panel 260. The carton at this stage appears as in FIG. 12. Top end wall panel 256 and bottom end wall panel 260 have hingedly attached to their front edges tapered three-creased flaps 270 and 280 which form the confining means. Flap 270 tapers outwardly from the front of the carton and is divided into four panels 272, 274, 276 and 278 by three crease lines 273, 275 and 277. The flap at its rear end carries a chime-engaging tab 258 formed by cut lines 254 and 255 and by arcuate cut-out portion 271. Flap 280 is identically configured to have panels 282, 284, 286 and 288, crease lines 283, 285 and 287, chime-engaging tab 262, cut lines 264 and 265 and arcuate cut-out portion 281. To load the rigid container after loading of the pouch, flap 270 is folded downwardly about hinge line 257 and flap 280 is folded upwardly about hinge line 259. Upon loading the can the flaps are pushed into the carton. The flaps are so constructed that they are wider at the front edge than at the hinge line from the respective top and bottom end panels and are slightly greater in width than the width of the carton. To accommodate for this greater width, when the flap is pushed into the carton, the middle crease line 275 and inner flap panels 274 and 276 will buckle either inwardly or outwardly. As seen in FIGS. 12 and 13, the flap buckles outwardly and this buckling functions to raise outer flap panels 272 and 278 which become semi-wedged against the sidewalls. Thus when the flap is inside the carton, the inner and outer flap panels have an almost v-shaped contour. As seen in FIG. 15, the flap may alternatively buckle inwardly to provide a similar wedging action of the outer flaps against the sidewalls. This wedging action, whether caused by inward or outward buckling, serves to define an area in the container beyond which the rigid container cannot go. This action also wedges the chime-engaging tab 258 against the container chime and functions to hold it in place and to thus secure the container in the package. The flap 280 is identically configured at the bottom and functions identically as just described.

It will be noted from the blank illustrated in FIG. 11 that the fold lines 257 and 259 by which the flaps 270 and 280 are connected to the respective top and bottom wall panels are preferably not straight in configuration. Preferably the area of the fold line from which the chime engaging tabs depend is substantially linear while that portion from which the outer panels of the flap depend from the respective top and bottom walls, e.g., 272 and 278 or 288 and 282, creates an angle with the said substantially linear portion. From the point of intersection of lines 255 and 257, for example, that portion of line 257 attached to panel 278 angles downward toward the base of the carton 220. The lines attaching 272, 282 and 288 depend in like manner from their respective points of intersection with lines 257 and 259. This feature serves to minimize the stresses exerted on the flap corners upon folding the flaps into the carton thereby preventing tearing and cracking at these stressed points.

Figure 16:
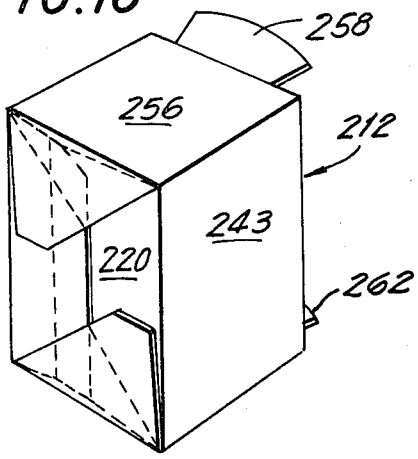
FIG. 16 is a perspective view of the back of a modification of the carton of FIG. 12.
Figure 14:
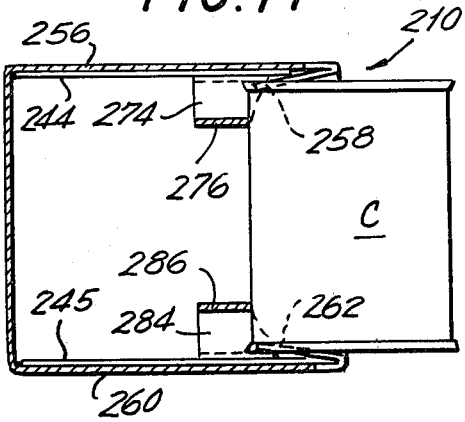
FIG. 14 is a cross-sectional view of the package constructed from the carton of FIG. 13 (without showing the pouch)

A modification of end wall 220 which may be employed with all combinations of confining and securing means is illustrated in FIG. 16 in which the carton is collapsible and has an automatic bottom. Such feature per se is well known in the art and may be constructed for example, as disclosed in U.S. Pat. No. 2,781,160 issued Feb. 12, 1957. A further modification of a carton employing the three-creased flap-chime engaging tab means just described is also illustrated in FIGS. 17 to 19, where the confining and securing means are the same as in the embodiment just described, the modifications being in arrangement of the carton walls, provision of glue flaps 335, 324, 332 amd 329, enclosing band 337, slot 344 and locking tab 338. In this embodiment, after assembly of the carton as shown in FIG. 18 and after loading the pouch and rigid container, the enclosing band 337 is wrapped around the projecting container and locking tab 338 is inserted in slot 344 carried on sidewall 343. The locking tab 338, hingedly connected to enclosing band 337 by fold line 336, has an end projection 339 and an inner projection 341 formed by cut line 340. To close the package, the band is wrapped around to overlap slot 344. Lifting of end projection 339 of tab 338 causes the inner projection 341 to slip into slot 344.

TAPERED WALLS WITH SEMI-CIRCULAR CUT LINES

Figure 20:
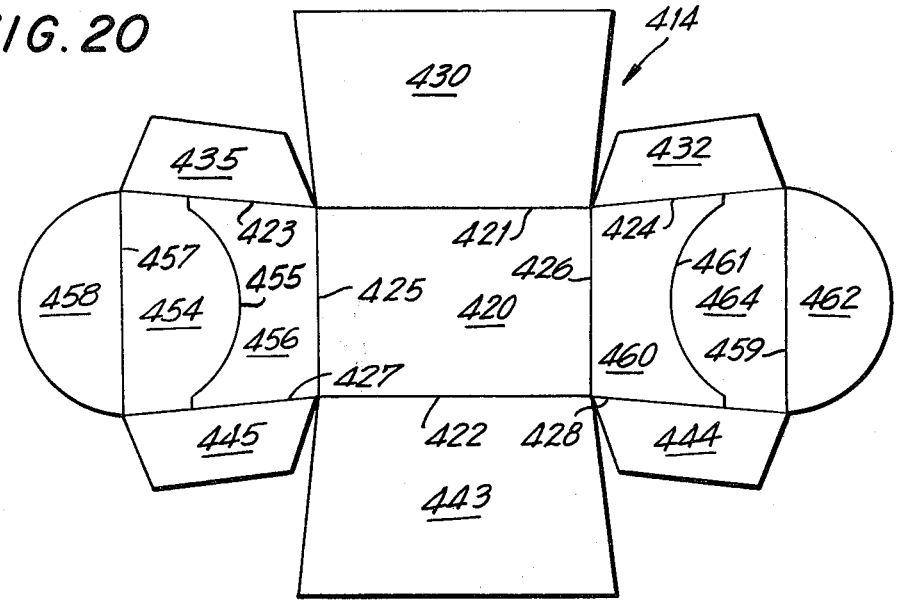
FIG. 20 is a plan view of a carton blank comprising another preferred embodiment of the invention.
Figure 21:
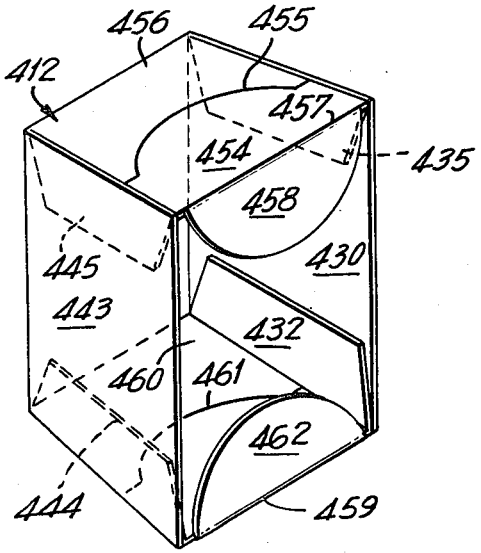
FIG. 21 is a perspective view of the empty constructed carton.
Figure 22:
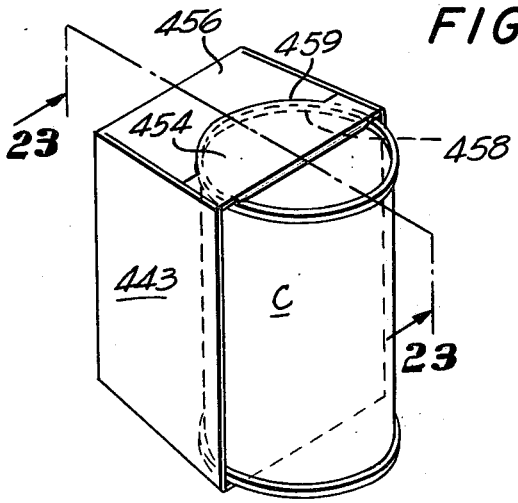
FIG. 22 is a perspective view of the package constructed from the carton of FIG. 21.
Figure 23:
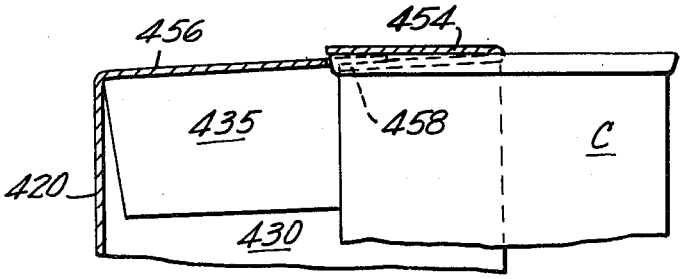
FIG. 23 is an enlarged fragmentary cross-sectional view of the package of FIG. 22 taken along the line 23—23 (without showing the pouch)
Figure 24:
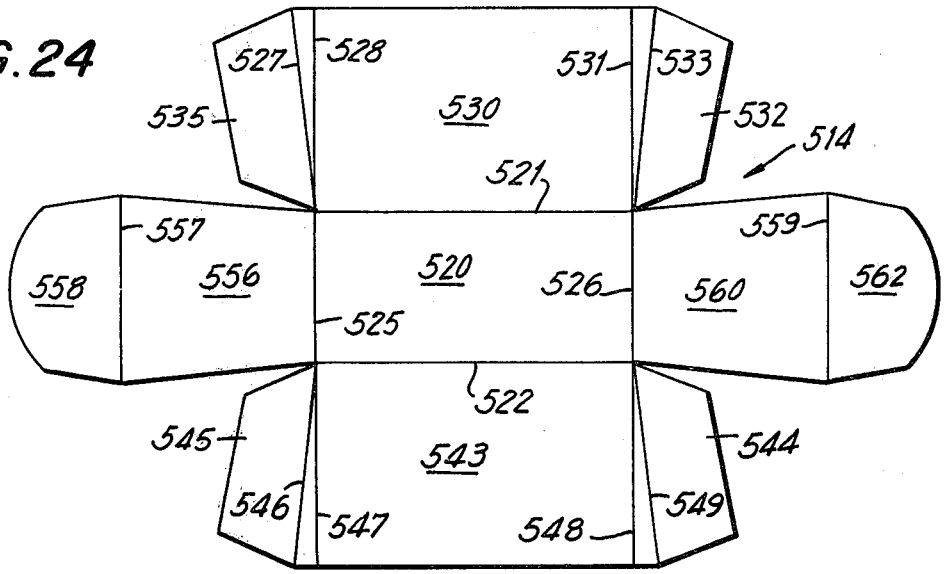
FIG. 24 is a plan view of a carton blank comprising another preferred embodiment of the invention.

A further alternative type of confining means included in the present invention is illustrated in FIGS. 20 to 23 wherein the confining means are tapered walls and semi-circular cut lines on the top and bottom end wall panels. In this embodiment, blank 414 comprising end walls 420, 456 and 460 and sidewalls 430 and 443, glue flaps 432, 435, 444 and 445 are folded about their respective fold lines 421–428 and the glue flaps adhered to the top and bottom of the sidewalls. The erected carton is illustrated in FIG. 21. As best seen in FIG. 20, end walls 456 and 460 and sidewalls 430 and 443 are wider at their outer ends tapering inwardly toward their respective hinge lines. In the erected carton 412, the tapering results in a construction that tapers toward the bottom or back of the carton becoming progressively narrower from front to back. Additionally, top end 456 and bottom end 460 have arcuate cut lines 455 and 461, respectively and carry semi-circular chime engaging tabs 458 and 462 hingedly connected thereto by fold lines 457 and 459. Upon loading the container, both the tapering of the carton walls and the arcuate cut lines 455 and 461 define a space in the carton beyond which the container cannot go. While the chime engaging tabs 458 and 462 function to grab the container chimes and forcibly hold it in the carton, the cut-lines define arcuate portions 454 at the top and 464 at the bottom which are forced outwardly by the can chimes and provide a stopping or confining point.

TAPERED WALLS WITH PAIRED TAPERED SCORE LINES

Figure 25:
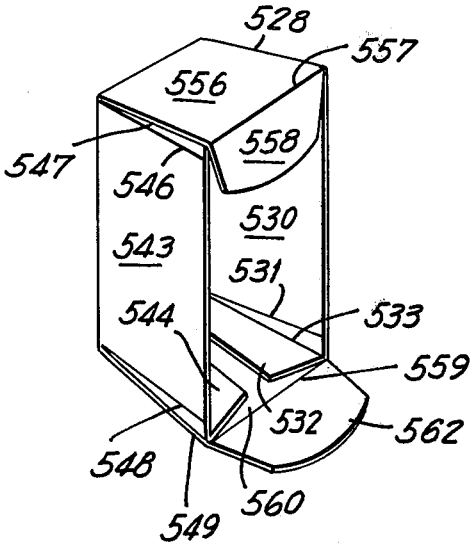
FIG. 25 is a perspective view of the empty constructed carton.
Figure 26:
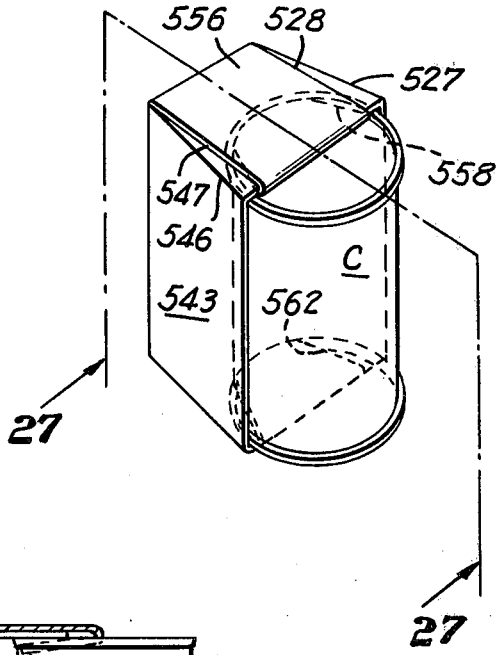
FIG. 26 is a perspective view of the package constructed from the carton of FIG. 25.
Figure 27:
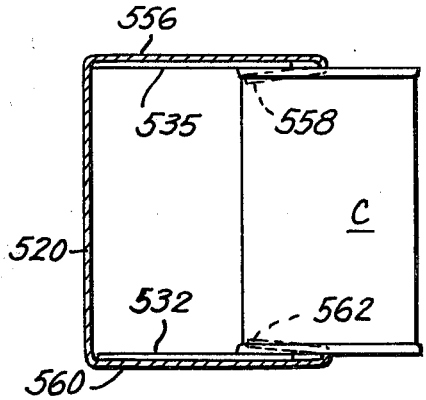
FIG. 27 is a cross-section of the package of FIG. 26 taken along the line 27—27 (without showing the pouch).

A modification of this form of confining means is illustrated in FIGS. 24 to 27 wherein blank 514 differs from blank 414 previously described primarily in the provision of glue flaps 535, 532, 544 and 545 on the side walls 530 and 543 which are hingedly connected thereto by paired tapering score lines 527 and 528, 531 and 533, 546 and 547 and 548 and 549 which are tapered as the carton is tapered, i.e. they become wider toward the front of the carton. In this embodiment, the tapered walls of the carton together with the paired tapered score lines provide the confining means while the arcuate chime engaging tabs provide the securing means. Assembly of the carton is as previously described except that prior to adhesively securing the glue tabs, they are folded on the outermost score lines 527, 533, 546 and 549 and then attached to the respective top and bottom end panels 556 and 560. In so doing, the inner score lines 528, 531, 547 and 548 will be on the top and bottom sides of the sidewalls as best seen in FIG. 25. The carton blank (and erected carton) is so dimensioned that upon loading the carton with the container it is actually widened and shortened. For example, upon loading the initially narrow, tall carton with the container, the chimes of the container engage the front portion of the inner score lines causing a stretching between the paired score lines and changing the taper of the carton as best seen in FIG. 26 wherein the taper has been changed to the extent that the score lines have been moved from the sides to the respective top and bottom ends of the carton. In essence, the height of the sidewall defined by the paired score lines thereon, has been transferred to the width of the top and bottom ends by the stretching action resulting from loading the container. The score lines are tapered to be narrower at the back of the carton and therefore restrict the top and bottom width in these areas of the carton. This feature, i.e. tapered carton walls and paired tapered score lines define the area of the carton beyond which the container cannot go. The chime engaging tabs 558 and 562 assume the function previously described to positively secure the container within this area.

It will be obvious that the relative sizes of the cartons and containers described hereinabove are interrelated although they may be varied to accommodate different sizes of containers. In the embodiments described hereinabove for purposes of illustration, the square cartons were for example $3\frac{3}{8}\times4\frac{1}{4}\times3\frac{1}{8}$ inches employing a $303\times406$ container. The tapered carton with arcuate cut-lines illustrated is $2\frac{3}{4}\times3\frac{3}{4}\times2\frac{1}{2}$ inches while the tapered carton with paired tapered corner score lines illustrated is $2\ 13/16\times4\frac{3}{8}\times2$ inch, each used with a $303\times406$ container. Dimensions of cartons and containers may vary as desired, it being necessary, however, that the container be dimensioned to approximate substantially the same height and width of the carton opening or to be slightly larger than the opening since containers substantially shorter or narrower would simply slip into the carton without contact with the confining and securing means and thereby defeat their functions.

Moreover, while the chime-engaging tabs have been described as preferably being semi-circular in shape, the shape thereof may be varied as desired so long as they function to engage the container chime and positively secure the container as hereindescribed.

We claim:

1. In combination, a single-compartment carton folded from a blank and a multi-component product contained therein, said product comprising a rigid product container having end chimes thereon and a damage-susceptible flexible product container, said carton comprising: a plurality of connected foldable panels defining bottom, side, end, and top walls of said carton; crossed minor flaps for confining said rigid product container in a predetermined area and creating a space for containing said flexible product container behind said rigid product container, said flaps being formed from said sidewalls of said carton and adhesively secured to said top and bottom walls and projecting into said carton to contact said rigid product container and to define said predetermined area for confining said rigid product container; and non-adhesive means on said top and bottom walls for engaging said rigid product container chimes to positively secure said rigid product container against movement into or out of said carton.

2. A blank erectible into a single-compartment carton for receiving, confining and positively securing a chimed container in fixed position in a predetermined area therein comprising:

a plurality of connected foldable panels defining bottom, side, end and top walls of a carton having an interior multi-product receiving space when said panels are folded to carton form, said sidewall-defining panels having a pair of glue flaps foldably connected to their lateral edges and each of said glue flaps being foldably connected to minor flaps, a minor flap on one sidewall on the top of said carton and a minor flap on one sidewall on the bottom of said carton each having a slot with flanking tabs and the minor flaps on the opposite sidewalls having a tab with flanking slots, said minor flaps projecting into the erected carton in crossed and locked position, the tab of one minor flap being inserted in the slot of the minor flap on the opposite sidewall, thereby to define an area in which the chimed container is to be confined in the erected carton and said top and bottom wall-defining panels each having front and rear edges, and each having an arcuate chime engaging tab hingedly connected to its respective front edge to positively secure said chimed container in fixed position when said arcuate tabs are folded into the erected carton.

* * * * *